United States Patent [19]

Crowe et al.

[11] 4,133,227

[45] Jan. 9, 1979

[54] DIRECT MACHINING METHOD OF MANUFACTURE OF ISOSTRESS CONTOURED DIES

[75] Inventors: John J. Crowe; Leslie C. Kun, both of Williamsville; George E. Nies, East Aurora, all of N.Y.

[73] Assignee: Union Carbide Corporation, New York, N.Y.

[21] Appl. No.: 798,150

[22] Filed: May 18, 1977

[51] Int. Cl.[2] ..... B21K 5/20

[52] U.S. Cl. ..... 76/107 R; 29/445; 29/525; 29/558

[58] Field of Search ..... 76/107 R, 107 C; 29/558, 445, 525

[56] References Cited

U.S. PATENT DOCUMENTS

| | | | |
|---|---|---|---|
| 2,165,008 | 7/1939 | Rosenberg | 76/107 R X |
| 2,440,963 | 5/1948 | Luce | 76/107 R |
| 2,552,455 | 5/1951 | Pond | 76/107 R X |
| 3,100,411 | 8/1963 | Airlie | 76/107 R X |
| 3,151,504 | 10/1964 | Pare et al. | 76/107 R |
| 3,498,158 | 3/1970 | Kougel | 76/107 R |
| 3,895,947 | 7/1975 | Sarka | 76/107 R X |
| 3,910,138 | 10/1975 | Sinha et al. | 76/107 C |
| 4,024,623 | 5/1977 | Kun | 76/107 R X |

*Primary Examiner*—Charlie T. Moon
*Attorney, Agent, or Firm*—Steven J. Hultquist

[57] ABSTRACT

A method of forming an isostress-contoured die from a metal workpiece by discreet, sequential machining steps. A plurality of spaced-apart truncated conoidal projections, arranged in repetitive diamond-shaped patterns, are formed from the workpiece. Depressions are machined in the workpiece portions associated with each diamond pattern and the ridges between adjacent depressions are reduced by machining to form isostress-contoured surface portions between and surrounding the projections.

10 Claims, 12 Drawing Figures

DIRECT MACHINING METHOD OF MANUFACTURE OF ISOSTRESS CONTOURED DIES

BACKGROUND OF THE INVENTION

1. Field of the Invention

This invention relates to an improved method for forming an isostress-contoured die, such as may suitably be employed for forming isostress-contoured sheets from thin metal.

2. Description of the Prior Art

A number of industrial heat exchange applications have created a demand for lightweight, inexpensive heat exchangers formed from thin-walled heat exchange channel elements. In U.S. Pat. No. 3,757,856 to L. C. Kun a lightweight, potentially inexpensive heat exchange element is disclosed which can be used to fabricate a heat exchanger of exceptional strength and excellent heat transfer performance characteristics. The Kun heat exchanger comprises an array of parallel channels formed of thin heat conductive walls which have on their surface isostress contours with uniformly disposed unidirectional wall-supporting projections formed from the wall. An isostress surface is mathematically described in the Kun patent, as representing a surface having a multiplicity of continuously curved isostress-contours thereon; each contour is devoid of flat segments and resembles the curved contour of a shear-free "soap bubble membrane".

The aforementioned Kun patent teaches a method of forming a stamping die with which heat exchange walls can be fabricated from thin sheet metal. This method involves fabricating a block having on its surface multiple vertical projection supports forming a pattern and being dimensionally sized to correlate to the pattern and size of the wall-supporting projections desired in an isostress-contoured surface. Upwarding extending sides are provided around the edges of the block, thereby providing a recess or cavity which contains the vertical supports. The so-formed cavity is connected to depressurizing means so that when a flexible material is tensionally secured across the top of the cavity and also contacting and supported by the vertical projected supports, the depressurizing means can be operated to force the unsupported portion of the flexible material into the cavity while the vertical projected supports prevent deflection of the supported portion of the flexible material, thereby causing the flexible material to assume isostress-contours between and surrounding the supported portions which correspond to the wall-supporting projections. Subsequently, a form-setting material, i.e., a thermosetting resin, can be deposited onto the flexible material and when properly cured, the depressurizing means can be deactivated. The cured material having the isostress-contoured surface with substantially uniformly disposed unidirectional wall-supporting projections is then ready to be used as a die.

Despite its relative simplicity, the method for forming a die disclosed in the Kun patent is characterized by several severe deficiencies. For example, the form-setting material used to fashion the die does not provide a long life in the severe metal stamping service for which it is employed. In addition, the isostress surface thus formed by the membrane deformation method may deviate from the ideal isostress surface as a consequence of variations of the elastic modulus over the extent of the membrane and excessive localized stretching of the membrane in the areas approximate to the vertical projection supports.

Concerning the short practical service life for the die formed by the membrane deformation method of Kun, some improvement can be obtained by employing the resin die as a template to fabricate a steel die by a single point electric discharge machining (EDM) operation. Nonetheless, polishing and heat annealing of the thus-formed steel die, or, alternatively, depending on material hardness, polishing and stress-relieving of the die, are required to finish the die surface and the finishing process is expensive and subject to cumulative dimensional variations.

The resin die formed by the membrane deformation method of Kun can also be used as a pattern for the precision casting of a steel die; however, such casting requires polishing, finishing and heat treating which causes undesirable sizing variations. The overall die forming process thus includes the operations of casting, polishing, finishing and heat treating. As a result the finished article suffers from the accumulation of dimensional errors in the constituent steps and it is comparatively difficult and expensive to maintain such accumulation of dimensional errors at a suitably low level.

As an alternative to the above described die forming methods, a metal die can be machined employing a milling or cutting machine capable of numerical control in which the various metal cutting tools are coupled with a computer programmed according to the equation for the three-dimensional isostress surface. The computer in this system directs the three-dimensional manipulation of a single point metal removal tool. This process again is expensive and, in common with the above described methods, involves a polishing and finishing step, with the disadvantages attendant the utilization of such polishing and finishing steps, as already described.

Accordingly, it is an object of the present invention to provide a method of fabricating a metal die whose surface is a substantially isostress-contoured surface, by simple and inexpensive machining steps which produce an isostress surface to a predictable close tolerance, thereby minimizing the amount of polishing and hand finishing which is required to produce the finished die.

Other objects and advantages of the invention will be apparent from the ensuing disclosure and appended claims.

SUMMARY OF THE INVENTION

The present invention is directed to a method for forming an isostress-contoured die from a metal workpiece.

The instant invention comprises forming from the workpiece a plurality of outwardly extending, spaced-apart truncated conoidal projections with concavely shaped side wall portions surrounded by flat planar surface portions. The projections are arranged in repetitive diamond-shaped patterns having projections disposed at the apices thereof, such that respective pairs of adjacent projections in each diamond pattern are common with an adjacent diamond pattern. Each diamond pattern has a minor axis $D_1$ and a major axis $D_2$ defined by center-to-center distances between oppositely disposed projections of the pattern. with each projection having a substantially flat top surface of equivalent diameter d and a circular base at the juncture of the projection with the surrounding planar surface portions, and with the substantially flat top surfaces of the projections in a common plane parallel to the plane defined by the flat planar surface portions of the workpiece. The forming step is carried out such that the dimensional relationship between the diamond pattern minor axis $D_1$, major axis $D_2$ and projection flat top surface equivalent diameter d is defined by $$D_1 \geqq 0.2 \text{ inch},$$
$$0.2 \leqq \frac{(D_1^2 + D_2^2)^{\frac{1}{2}}}{2} \leqq 2.5 \text{ inches, and}$$
$$3 \leqq \frac{(D_1^2 + D_2^2)^{\frac{1}{2}}}{2d} \leqq 10.$$

Depressions are machined in the workpiece surface portions associated with each aforementioned diamond pattern. Each such depression has a perimeter which is at least partially circular with a circular perimetral portion tangent to at least one major axis projection of the diamond pattern at the base thereof, with the center of curvature of the circular perimetral portion lying on the major axis $D_2$ of the diamond pattern, and with the depression having a generally arcuate curved contour extending from the major axis projections in a plane containing the major axis line and perpendicular to the minor axis line, such that adjacent depressions overlap one another and ridges are formed between the adjacent depressions on the surface of the workpiece. The ridges between adjacent depressions are machined for at least partial reduction thereof, to form workpiece surface portions between and surrounding the projections which are continuously curved in contours of depth H, wherein H is the maximum distance measured perpendicularly from the plane defined by the substantially flat top surfaces of the projections enclosing the curved contour to the innermost crest of the contour, and the dimensional relationship between the contours and the projections is defined by $$0.05 \leqq \frac{2H}{(D_1^2 + D_2^2)^{\frac{1}{2}}} \leqq 0.2.$$

In one particularly preferred embodiment of the invention, the metal workpiece has a flat main surface and the projections-forming step comprises jig-boring holes in the flat main surface at the apices of the aforementioned diamond patterns. Pin members are inserted into the bored holes, the pin members being shaped at their lower extremities for close fitting in the holes and with their upper extremities forming the aforementioned truncated conoidal projections.

In another preferred embodiment of the invention, the depressions are machined by transverse movement of a penetrated end milling tool for a distance $D_2$-$D_1$ along the major axis of the diamond pattern. In practice, the depressions may suitably be of elongated shape, with circular perimetral portions at the longitudinal extremities of the depression each tangent to the base of a major axis projection of the associated diamond pattern, and with longitudinally extending side perimetral portions each tangent to the base of a minor axis projection of the diamond pattern.

As used herein, the term "isostress-contoured die" means a die having a plurality of isostress-contours on a surface thereof, wherein each contour has a multiplicity of radii with substantially no flat segments and resembles the curve contour of a shear-free "soap bubble" membrane. The lack of flat or pointed surface segments substantially eliminates stress concentration points in the thin sheet metal which is stamped by the isostress-contoured die when such sheet is subjected to a differential pressure across its surface areas, as disclosed in U.S. Pat. No. 3,757,856, incorporated herein to the extent pertinent.

The term "forming from the workpiece a plurality of outwardly extending, spaced-apart truncated conoidal projections with concavely shaped side wall portions surrounded by flat planar surface portions" is intended to be broad enough to cover the above-described method of jig-boring holes in a surface of the workpiece and inserting pin members into the holes, as well as methods such as hollow end milling of the workpiece surface in which the truncated conoidal projections are cut by the milling tool into the workpiece.

BRIEF DESCRIPTION OF THE PREFERRED EMBODIMENTS

In the further discussion of preferred embodiments of the present invention, reference will be made to 1 -, 2 -, and 3 - dimensional machining. 3 - dimensional machining involves translating, in a controlled fashion, the workpiece being machined relative to the metal removal tool or the metal removal tool relative to the workpiece such that the translation has three degrees of freedom, i.e., two in the horizontal plane and one in the vertical plane. This operation thus involves controlling travel of the translated part in each of the three directions in which the part is free to translate. 1 - dimensional machining is carried out by controlling the vertical translation of a rotating cutting tool, thus providing one degree of freedom in the machining operation. 2 - dimensional machining involves 2 degrees of freedom, i.e., introducing a rotating cutting tool into a workpiece and linearly translating the thus-introduced tool in the horizontal plane. As used herein the term "penetrated end milling tool" means an end milling tool which has partially cut into the workpiece surface to a predetermined depth, so that thereafter the milling tool may be employed for 2 -dimensional machining.

Figure 1:
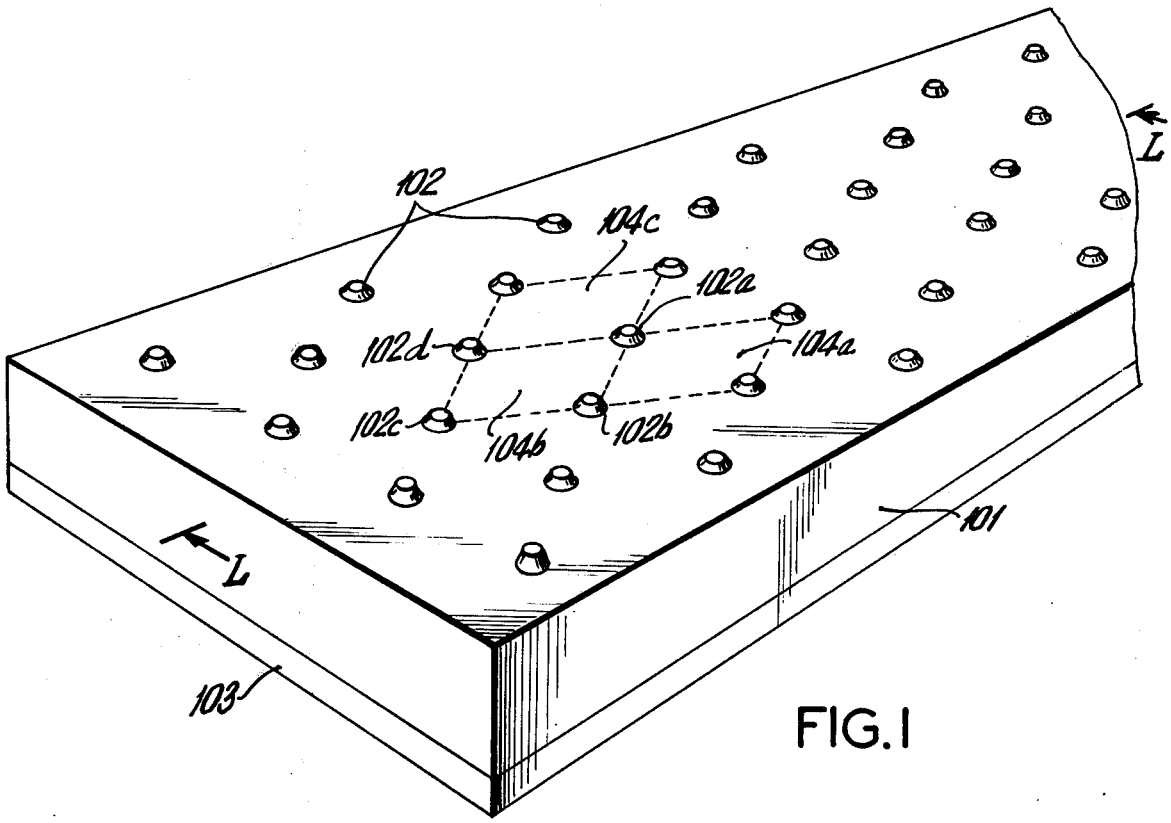
FIG. 1 is a metal workpiece from which a plurality of outwardly extending, spaced-apart truncated conoidal projections has been formed.

Referring now to FIG. 1, a portion of a metal workpiece is shown from which a plurality of outwardly extending, spaced-apart truncated conoidal projection has been formed. The truncated conoidal projections 102 have concavely shaped side wall portions surrounded by flat planar surface portions of the metal workpiece 101. The workpiece 101, as shown, may be disposed on a backup plate 103 if the conoidal projections are formed by pin members which are inserted into jig-bored holes in the workpiece, as described more fully hereinafter. As an alternative to such hole boring and pin insertion method, the surface as shown may suitably be formed by hollow end milling of the workpiece by an end milling tool with a truncated conoidal cavity in its cutting surface, which is employed for cutting the truncated conoidal projections into the workpiece.

The spaced-apart truncated conoidal projections are arranged on the workpiece upper surface in repetitive diamond-shaped patterns, e.g., **104*a*, 104*b* and 104*c*, having projections disposed at the apices thereof, such that respective pairs of adjacent projections in each diamond pattern, as for example projections 102*a* and 102*b*, are common within adjacent diamond pattern, as in the adjacent diamond patterns 104*a* and 104*b*. Each diamond pattern has a minor axis $D_1$ and a major axis $D_2$ defined by center-to-center distances between oppositely disposed projections of the pattern. Each projection has a substantially flat top surface of equivalent diameter d and a circular base at the juncture of the projection with the surrounding planar surface portions of the workpiece. The substantially flat top surfaces of the projections are in a common plane parallel to the plane defined by the flat planar surface portions of the workpiece surrounding the conoidal projections. The initial forming step, carried out to produce a workpiece configuration such as is shown in FIG. 1**, is performed such that the dimensional relationship between the diamond pattern minor axis $D_1$, major axis $D_2$ and projection flat top equivalent diameter d is defined by $$D_1 \geqq 0.2 \text{ inch}$$

$$0.2 \leqq \frac{(D_1^2 + D_2^2)^{\frac{1}{2}}}{2} \leqq 2.5 \text{ inches, and}$$

$$3 \leqq \frac{(D_1^2 + D_2^2)^{\frac{1}{2}}}{2d} \leqq 10.$$

Figure 2:
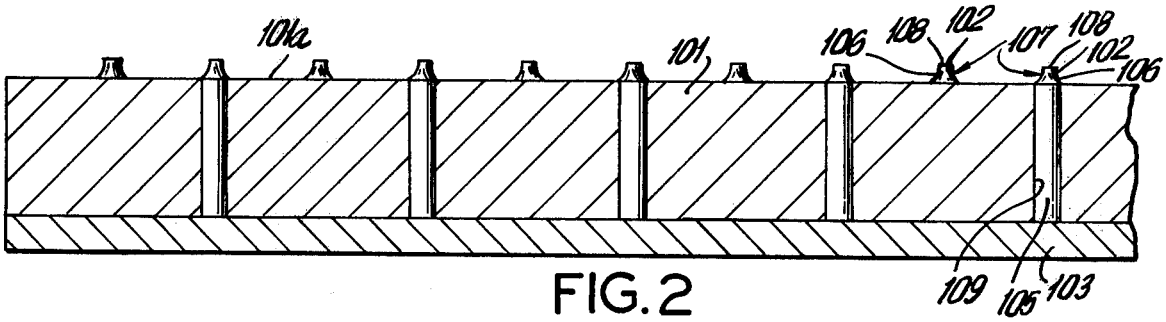
FIG. 2 is an elevational view in cross section of the metal workpiece, taken along line L—L of FIG. 1.
Figure 3:
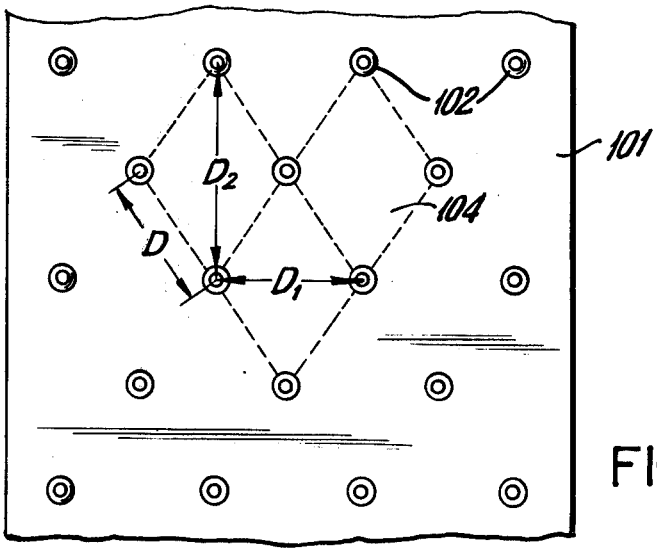
FIG. 3 is a plan view of FIG. 1 metal workpiece, showing the dimensional characteristics of the diamond shaped patterns thereon.

FIG. 2 shows a cross-sectional, elevational view of the workpiece in FIG. 1, where the workpiece has been subjected to the boring and pin insertion sequence previously referred to. As mentioned earlier, the workpiece shown in FIG. 1 can suitably be fabricated by end milling of the conoidal projections shown therein. The metal workpiece 101 in FIG. 2 has a flat main surface **101*a* and the projections-forming step has been carried out by jig-boring holes 109 in the flat main surface at the apices of the diamond patterns for the die and inserting pin members 107 into the holes. The pin members are shaped at their lower extremities 105 for close fitting in the holes 109 and with their upper extremities forming the truncated conoidal projections 102. The truncated conoidal projections 102 have concavely shaped side wall portions 106 surrounded by flat planar surface portions of the workpiece main flat top surface 101*a*. Each projection has a substantially flat top surface 108 of equivalent diameter d and a circular base at the juncture of the projection with the surrounding planar surface portions of surface 101*a*. As shown, the flat top surfaces of the respective projections are in a common plane parallel to the plane defined by the flat planar surface portions of the surface 101*a*. In this embodiment the holes 109 are jig-bored through the metal workpiece 101 and then the latter is disposed on top of the backup plate 103 to provide support for the pins inserted into the holes. Alternatively the holes 109 may be jig-bored only part way into the workpiece, such that their depth is less than the thickness of the workpiece 101. FIG. 3 is a plan view of the FIG. 1** workpiece, showing the dimensional characteristics of the diamond patterns. Adjacent projections in any given diamond pattern are spaced apart by distance denoted as D and each diamond pattern has a minor axis $D_1$ and a major axis $D_2$ defined by center-to-center distances between oppositely disposed projections of the pattern.

Figure 4:
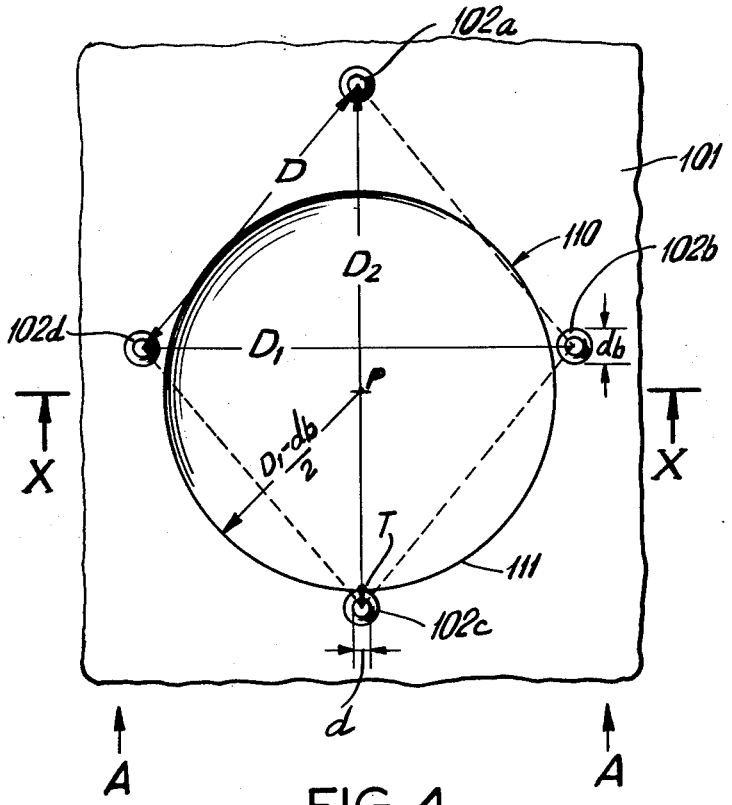
FIG. 4 is a plan view of a portion of a metal workpiece, of the general type shown in FIG. 1, in which a depression has been machined in the workpiece surface portion associated with a diamond pattern.
Figure 5:
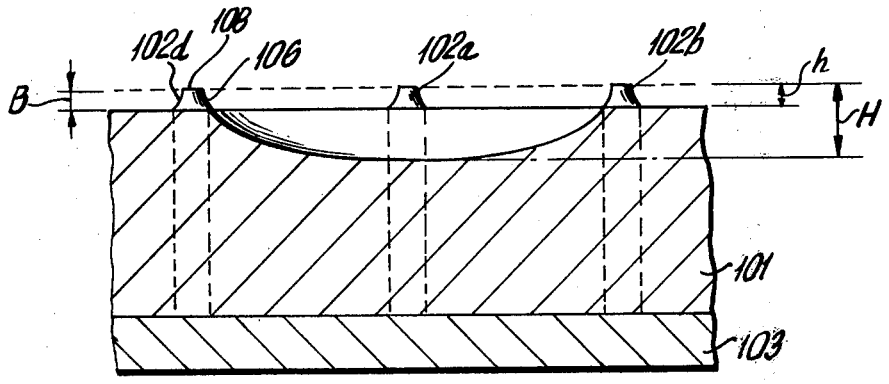
FIG. 5 is a cross-sectional, elevational view taken along line X—X of FIG. 4.

FIG. 4 shows a depression machined in the workpiece surface portion associated with the diamond pattern formed by conoidal projections **102*a*–*d*. The depression has a perimeter 110 which is circular with a perimetral portion 111 thereof tangent to the major axis projection 102*c* of the diamond pattern at the base of the conoidal projection. The center of curvature of the circular perimetral portion 111 lies on the major axis $D_2$ of the diamond pattern. FIG. 5 shows a sectional, elevational view of the depression of FIG. 4 along the line X—X. As shown by these drawings, the depression has a generally arcuate curved contour extending from the major axis projection 102*c* in a plane containing the major axis line and perpendicular to the minor axis line of the diamond pattern. In the dish-like depression in the lower portion of the diamond pattern in FIG. 4, the diameter of the depression as shown is $D_1 - d_b$ where $D_1$ is the length of the minor axis and $d_b$ is the diameter of the base of the conoidal projection. The central axis p of the depression is located on the major axis $D_2$ and is spaced $(D_1 - d_b)/2$ from the base of the major axis conoidal projection 101*c*. The circular perimetral portion 111** of the depression blends with the base of the conoidal projection at the point of tangency T thereby forming the smooth surface devoid of localized flat segments which is characteristic of the isostress surface taught by U.S. Pat. No. 3,757,856 to L. C. Kun. The Kun patent teaches a spacing D between the centers of the closest adjacent projections of between 0.2 and 2.5 inches and an H/D ratio of between 0.05 and 0.2 wherein H is the maximum distance measured perpendicularly from the plane B defined by the substantially flat top surfaces of the projections enclosing the curved contour to the innermost crest of the contour, as shown in FIG. 5. As also shown in FIG. 5, the height h of the conoidal projections is measured by the vertical distance between the plane B containing the substantially flat top surfaces of the projections to the plane A defined by the main flat top surface of the workpiece.

Figure 6:
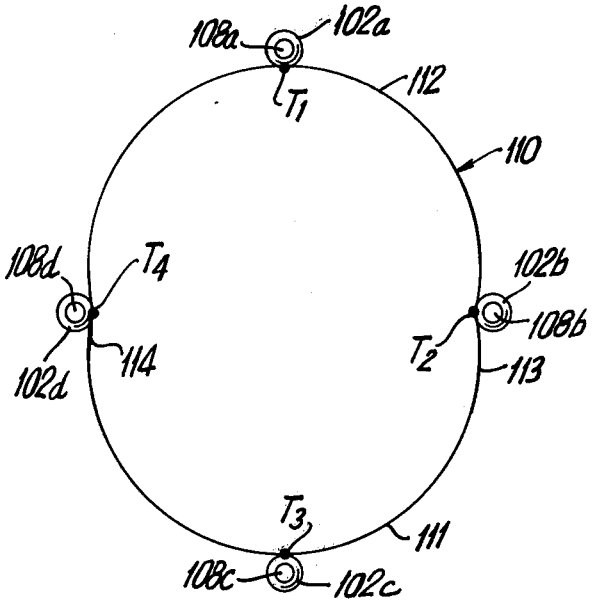
FIG. 6 shows a depression machined in the workpiece surface portion associated with a diamond pattern, as machined by transverse movement of a penetrated end milling tool along the major axis of the diamond pattern.

FIG. 6 shows a depression which has been machined in the workpiece surface portion associated with the diamond pattern formed by conoidal projections 102*a–d* having substantially flat top surfaces 108*a–d*. This depression is of a type which is machined by transverse movement of a penetrated end milling tool for a distance $D_2 - D_1$ along the major axis of the diamond pattern. The depression is of elongated shape with circular portions 111, 112 of the perimeter 110 at the longitudinal extremities of the depression respectively tangent to the bases of the major axis projections 102*c*, 102*a* at the tangent points $T_3$, $T_1$. The longitudinally extending side portions 113, 114 of the perimeter 110 are respectively tangent to the bases of the minor axis projections 102*b*, 102*d* of the diamond pattern.

Figure 7:
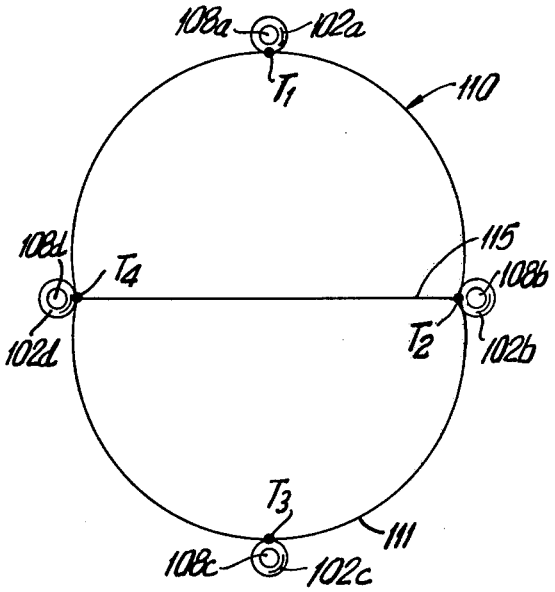
FIG. 7 shows adjacent depressions which have been machined in the workpiece surface portion associated with a diamond pattern, wherein the adjacent depressions overlap one another and from a ridge therebetween.

FIG. 7 shows a pair of adjacent depressions machined in the workpiece surface portion associated with the diamond pattern defined by projections 102*a–d*. Each depression has a perimeter which is at least partially circular with the circular perimetral portions 111, 112 respectively tangent to one major axis projection (102*a* and 102*c*) of the diamond pattern at the base thereof. The centers of curvature of the respective circular perimetral portions 111, 112 lie on the major axis $D_2$ of the diamond pattern. Each depression has a generally arcuate curved contour extending from the major axis projection, the base of which it blends with, in a plane containing the major axis line and perpendicular to the minor axis line. In this manner the adjacent depressions overlap one another and a ridge 115 is formed between the adjacent depressions on the surface of the workpiece. In the final machining step for the FIG. 7 surface the ridge 115 between the adjacent depressions is machined for at least partial reduction thereof, to form workpiece surface portions between and surrounding the minor axis projection 102*b*, 102*d* which are continuously curved in contours of depth H, wherein H is the maximum distance measured perpendicularly from the plane defined by the substantially flat top surfaces of the projections enclosing the curved contour to the innermost crest of the contour, and the dimensional relationship between the contours and the projections is defined by $$0.05 \leqq \frac{2H}{(D_1^2 - D_2^2)^{\frac{1}{2}}} \leqq 0.2.$$

No such final machining step for ridge reduction is necessary between the minor axis projections 101*b*, 102*d* in the FIG. 6 surface portion inasmuch as the depression in that surface portion was formed by linear translation of the metal removal tool, without any resulting ridge formation between the minor axis projections.

Figure 8:
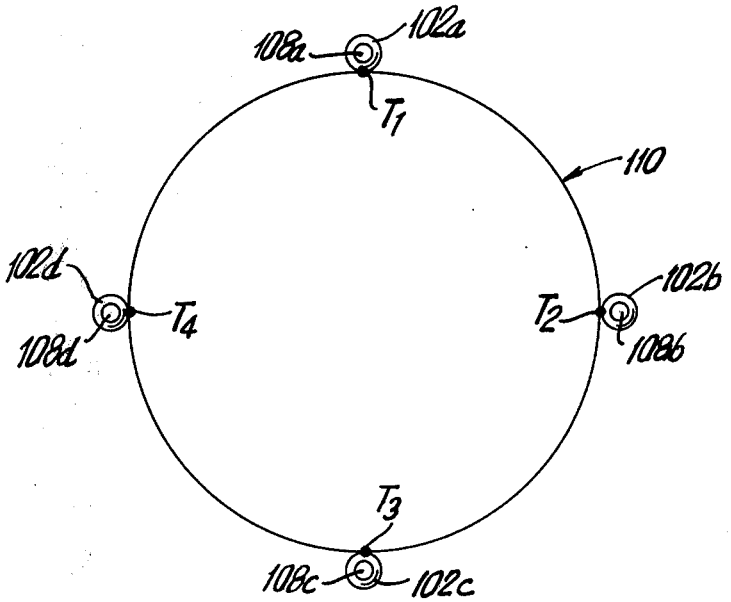
FIG. 8 shows a depression machined in a workpiece surface portion associated with a diamond pattern, wherein the diamond pattern is square in shape and the depression has a circular perimeter which is tangent to all four apex projections of the diamond pattern.

FIG. 8 shows a workpiece surface portion wherein the diamond pattern is square in shape and a depression is formed in the workpiece surface portions associated with the diamond pattern having a perimeter which is fully circular and tangent to all four apex projections 102*a–d* of the diamond pattern, the depression having a continuously curved contour of depth H at the intersection of the axes (major and minor axes) of the diamond pattern.

Figure 9:
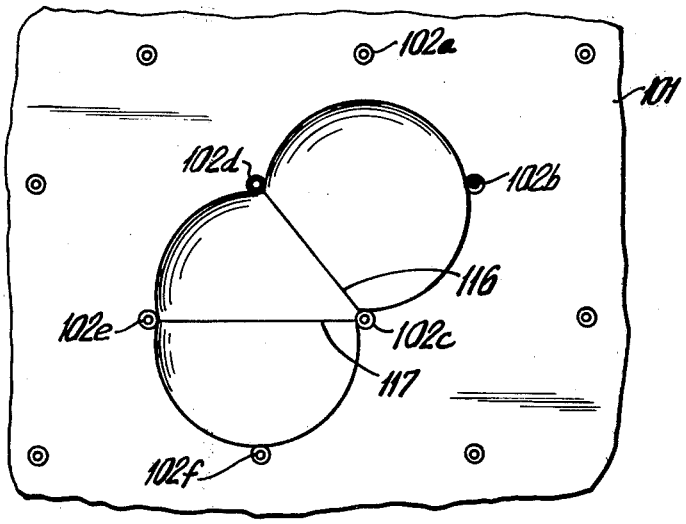
FIG. 9 shows a portion of the metal workpiece in which depressions have been machined in the workpiece surface portion associated with adjacent diamond patterns, wherein ridges are formed between the adjacent depressions on the surface of the workpiece.
Figure 10:
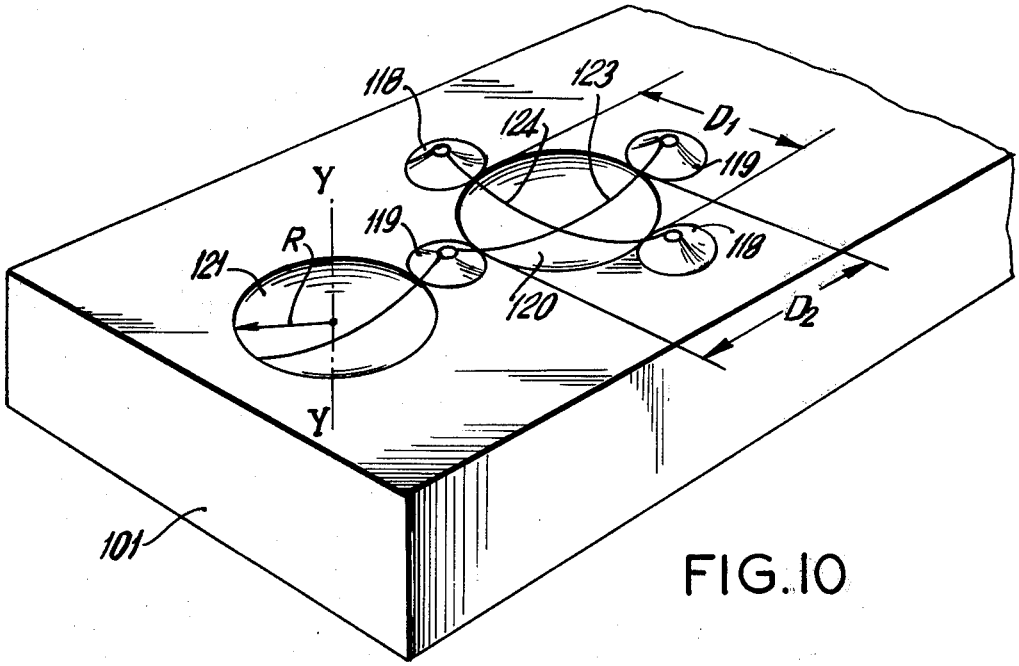
FIG. 10 shows a portion of a metal workpiece in which holes have been jig-bored and pin members with their upper extremeties forming truncated conoidal projections have been inserted into the holes and depressions have been machined in the workpiece surface portions associated with the diamond pattern formed by the holes and pin members.

FIG. 9 shows a partially finished workpiece portion in which depressions have been machined in the workpiece surface portion associated with the adjacent diamond patterns formed, on the one hand, by projections 102*a, b, c, d,* and, on the other hand, by projections 102*c, d, e, f.* The latter diamond pattern has depressions machined in each of the upper and lower parts thereof, and the former diamond pattern has a depression machined in the lower part thereof. In this manner the adjacent depressions overlap one another and ridges 116, 117 are formed between the adjacent depressions on the surface of the workpiece. In the final machining operation these ridges are machined for at least partial reduction or removal thereof, to form workpiece surface portions between and surrounding the projections which are curved in isostress-contours. FIG. 10 shows an isometric view of a partially formed workpiece 101 on the top surface of which depressions 120 and 121 have been machined, each of radius R measured from the central vertical axis Y—Y of the depression. The conoidal projections are formed by minor axis pin members 118 and major axis pin members 119, as shown. The linear distance between the central axes of the major axis pin members is $D_2$ and the linear distance between the central axes of the minor axis pin members is $D_1$. This drawing shows the isostress-contour 123 defined by the major axis pin members 119 and the intervening depression, as well as the isotress-contour 124 defined by the minor axis pin members 118 and the intervening depression 120.

Figure 11:
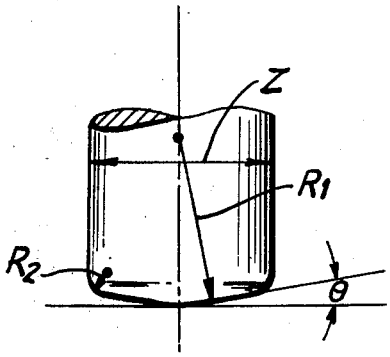
FIG. 11 shows an elevational view of an end milling tool such as may be suitably employed to machine the depressions in the FIG. 10 workpiece.

FIG. 11 shows an elevational view of an end milling tool such as may suitably be employed to form the depressions in the isostress-contoured die of this invention. The radius of curvature of the primary cutting surface of the end milling tool is $R_1$ and the radius of curvature of peripheral cutting surface is $R_2$, as shown. The end milling tool has a diameter Z and a cutting angle defined by the primary cutting surface of $\theta$. An illustrative physical example of an end milling tool such as may suitably be employed in the practice of the present invention will be set forth more fully herein below.

Figure 12:
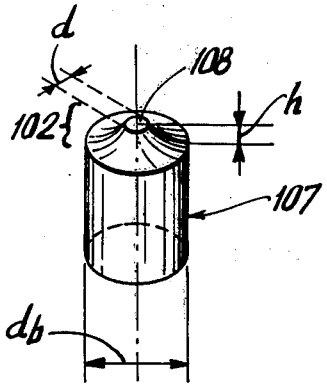
FIG. 12 shows a pin member such as may suitably be employed in connection with the FIG. 10 workpiece.

FIG. 12 is an isometric view of a pin member such as is suitably employed in the isostress-contoured die of FIG. 10. The pin member 107 has a lower cylindrical portion of diameter $d_b$ which is adapted for close fitting in the holes jig-bored to accommodate it. The upper extremity 102 of the pin member 107 forms the truncated conoidal projection of height h. The conoidal projection has substantially flat top surface 108 which is circular and has a diameter d.

The foregoing description of the method of this invention has been in terms of a sequence of first forming from the workpiece a plurality of outwardly extending, spaced-apart truncated conoidal projections, and a second step of machining depressions in the workpiece surface portions associated with the diamond pattern, followed by a final step of machining ridges between adjacent overlapping depressions for at least partial reduction thereof. However it is to be understood that various combinations of the sequence of steps may be carried out under the broad practice of the present invention. For example, the steps of machining depressions in the workpiece surface portions associated with each diamond pattern and machining the ridges between adjacent depressions for at least partial reduction thereof may be carried out prior to the step of forming from the workpiece a plurality of outwardly extending, spaced-apart truncated conoidal projections. In the depression machining step various 1 - and 2 -dimensional machining steps may be employed such as form grinding or EDM techniques. Furthermore, the step of machining the ridges between adjacent depressions for at least partial reduction thereof can be performed by traversing the ridge along its length with a metal removal tool of appropriate form. A form grinding wheel can also be used to effect such removal.

After the foregoing sequences of steps have been carried out, a hand-dressing operation may be performed, as for example with a riffler to eliminate any sharp corners which may be formed in the machining operation. The die surface can also then be polished with a felt pad impregnated with diamond dust to smooth the miniscule imperfections and surface asperities formed during the production of the die.

The finished die produced by the method of this invention is the male half of the die set and can be used as a pattern for the fabrication of the female half. The female die may be fabricated by casting a suitable resin or elastomeric material, e.g., polyurethane resin, and employing the machined male half of the set as the pattern therefor. The accuracy provided by the machining process of the present invention insures that the geometry of the isostress-surface of the male die is readily predictable and reproducible. In this respect, dimensional error accumulation on the surface of the female half of the die set is minimized as a consequence of the one step casting process, thereby insuring excellent fit of the female die with its male counterpart. The method of the present invention provides a high degree of accuracy in approaching a true isostress-countour on the die workpiece surface, relative to the methods heretofore used by the prior art.

By way of illustration, a steel die was formed from a workpiece of the type shown in FIG. 10, using pin members of the type shown in FIG. 12 and using an end milling tool of the type shown in FIG. 11 to machine the depressions in the workpiece surface portions associated with each diamond pattern. The pin members each had a base diameter $D_b$ of 0.161 inch and a projection height H of 0.03 inch. The flat top surface of the conoidal projection of the pin 108 had a diameter d of 0.05 inch. The pins were spaced such that the minor axis of the diamond element $D_1$ was 0.60 inch and the major axis $D_2$ was 0.70 inch. The depressions were milled with an end milling tool of the type shown in FIG. 11 having an overall diameter Z of 0.60 inch; however, the diameter of the principal cutting surface was $D_1 - db$, i.e., 0.439 inch, and therefore the radius of curvature $R_2$ of the peripheral cutting section of the tool was 0.22 inch. $R_1$ was 0.62 inch and the angle $\theta$ of the primary cutting surface was ten degrees. The depth of penetration of the milling tool in forming the depression was 0.022 inch and therefore H was 0.052 inch and $$\frac{(D_1^2 + D_2^2)}{2} = 0.462$$

$$\frac{(D_1^2 + D_2^2)^{\frac{1}{2}}}{2d} = 9.24$$

$$\frac{2H}{(D_1^2 + D_2^2)^{\frac{1}{2}}} = .1125$$

The steel die formed by the above-mentioned machining steps was in turn used to fabricate heat exchanger walls from 0.008 inch thick aluminum sheet material. The isostress-contoured aluminum sheet material stamped with the steel die was in turn employed for the manufacture of heat exchanger channel elements, which were assembled into a heat exchanger, as disclosed in the aforementioned U.S. Pat. No. 3,757,856 to Kun. The resultant heat exchanger was then hydraulically pressurized on the interior tube side. The heat exchanger proved to be leak-tight and structurally sound at pressure levels in excess of 50 psig, thereby inherently confirming the efficient formation of of the heat exchanger walls from the die manufactured in accordance with the present invention.

Although preferred embodiments of this invention have been described in detail, it is contemplated that modification of the method may be made and some features may be employed without others, all within the spirit and scope of the invention.

What is claimed is:

1. A method for forming an isostress-contoured die from a metal workpiece, comprising the steps of:

(a) forming from said workpiece a plurality of outwardly extending, spaced-apart truncated conoidal projections with concavely shaped side wall portions surrounded by flat planar surface portions, wherein said projections are arranged in repetitive diamond-shaped patterns having projections disposed at the apices thereof, such that respective pairs of adjacent projections in each diamond pattern are common with an adjacent diamond pattern with each diamond pattern having a minor axis $D_1$ and a major axis $D_2$ defined by center-to center distances between oppositely disposed projections of the pattern, with each projection having a substantially flat top surface of equivalent diameter d and a circular base at the juncture of the projection with the surrounding planar surface portions, and with the substantially flat top surfaces of said projections in a common plane parallel to the plane defined by said flat planar surface portions of said workpiece, the forming step being carried out such that the dimensional relationship between the diamond pattern minor axis $D_1$, major axis $D_2$ and projection flat top equivalent diameter d is defined by $$D_1 \geqq 0.2 \text{ inch}$$

$$0.2 \leqq \frac{(D_1^2 + D_2^2)^{\frac{1}{2}}}{2} \leqq 2.5 \text{ inches, and}$$

$$3 \leqq \frac{(D_1^2 + D_2^2)^{\frac{1}{2}}}{2d} \leqq 10\text{: and}$$

(b) machining depressions in the workpiece surface portions associated with each said diamond pattern, each said depression having a perimeter which is at least partially circular with a circular perimetral portion tangent to at least one major axis projection of the diamond pattern at the base thereof, with the center of curvature of said circular perimetral portion lying on said major axis $D_2$ of said diamond pattern, and with said depression having a generally arcuate curved contour extending from said major axis projections in a plane containing the major axis line and perpendicular to the minor axis line, such that adjacent depressions overlap one another and ridges are formed between the adjacent depressions on the surface of said workpiece, and machining said ridges between adjacent depressions for at least partial reduction thereof, to form workpiece surface portions between and surrounding said projections which are continuously curved in contours of depth H, wherein H is the maximum distance measured perpendicularly from said plane defined by the substantially flat top surfaces of the projections enclosing the curved contour to the innermost crest of the contour, and the dimensional relationship between the contours and said projections is defined by $$0.05 \leqq \frac{2H}{(D_1^2 + D^2)^{\frac{1}{2}}} \leqq 0.2$$

2. A method according to claim 1 wherein said metal workpiece has a flat main surface and the projections-forming step (a) comprises jig-boring holes in said flat main surface at said apices of said diamond patterns and inserting pin members into said holes, said pin members being shaped at their lower extremities for close fitting in said holes with their upper extremeties forming said truncated conoidal projections.

3. A method according to claim 2 wherein step (b) is carried out prior to step (a).

4. A method according to claim 1 wherein the projections-forming step (a) comprises hollow end milling of the workpiece surface by an end milling tool with a truncated conoidal cavity in its cutting surface, for cutting said truncated conoidal projections into said workpiece.

5. A method according to claim 1 wherein said diamond patterns are square in shape and depressions are formed in the workpiece surface portions associated with said diamond patterns having perimeters which are fully circular and tangent to all four apex projections of the diamond patterns, the depressions each having a continuously curved contour of depth H at the intersection of the axes of the respective diamond patterns.

6. A method according to claim 1 wherein said depressions in step (b) are machined by form grinding.

7. A method according to claim 1 wherein said ridges formed in step (b) are machined by form grinding.

8. A method according to claim 1 wherein said depressions in step (b) are of elongated shape, with circular perimetral portions at the longitudinal extremities of the depressions each tangent to the base of a major axis projection of the associated diamond pattern, and with longitudinally extending perimetral portions each tangent to the base of a minor axis projection of said diamond pattern.

9. A method according to claim 8 wherein said depressions are machined by transverse movement of a penetrated end milling tool for a distance $D_2$-$D_1$ along the major axis of the diamond pattern.

10. A method for forming an isostress-contoured die from a metal workpiece having a flat main surface, comprising the steps of:

(a) jig-boring holes in said flat main surface in repetitive diamond-shaped patterns having holes disposed at the apices thereof, such that respective pairs of adjacent holes in each diamond pattern are common with an adjacent diamond pattern, with each diamond pattern having a minor axis $D_1$ and a major axis $D_2$ defined by center-to center distances between oppositely disposed projections of the pattern, and inserting pin members into said holes, said pin members being shaped at their lower extremities for close fitting in said holes and with their upper extremities forming truncated conoidal projections with concavely shaped side wall portions, with each projection having a substantially flat top surface of equivalent diameter d and a circular base at the juncture of the projection with the surrounding flat main surface portions, and with the substantially flat top surfaces of said projections in a common plane parallel to the plane defined by said flat main surface of said workpiece, such that the dimensional relationship between the diamond pattern minor axis $D_1$, major axis $D_2$ and projection flat top equivalent diameter d is defined by $$D_1 \geqq 0.2 \text{ inch},$$

$$0.2 \leqq \frac{(D_1^2 + D_2^2)^{\frac{1}{2}}}{2} \leqq 2.5 \text{ inches, and}$$

$$3 \leqq \frac{(D_1^2 + D_2^2)^{\frac{1}{2}}}{2d} \leqq 10; \text{ and}$$

(b) machining depressions in the workpiece surface portions associated with each said diamond pattern, each said depression having an elongated shape, with circular perimetral portions at the longitudinal extremities of the depressions each tangent to the base of a major axis projection of the associated diamond pattern, and with longitudinally extending side perimetral portions each tangent to the base of a minor axis projection of said associated diamond pattern, with the centers of curvature of said circular perimetral portions lying on said major axis $D_2$ of said diamond pattern, and with said depression having a generally arcuate curved contour extending from said major axis projections in a plane containing the major axis line and perpendicular to the minor axis line, such that adjacent depressions overlap one another and ridges are formed between the adjacent depressions on the surface of said workpiece, and machining said ridges between adjacent depressions for at least partial reduction thereof, to form workpiece surface portions between and surrounding said projections which are continuously curved in contours of depth H, wherein H is the maximum distance measured perpendicularly from said plane defined by the substantially flat top surfaces of the projections enclosing the curved contour to the innermost crest of the contour, and the dimentional relationship between the contours and said projections is defined by $$0.05 \leqq \frac{2H}{(D_1^2 + D_2^2)^{\frac{1}{2}}} \leqq 0.2.$$

* * * * *